US006840259B1

(12) United States Patent
Russell et al.

(10) Patent No.: US 6,840,259 B1
(45) Date of Patent: Jan. 11, 2005

(54) DYNAMICALLY-MONITORED DOUBLE VALVE WITH RETAINED MEMORY OF VALVE STATES

(75) Inventors: Neil E. Russell, Bloomfield Hills, MI (US); Joseph E. Foster, Sterling Heights, MI (US)

(73) Assignee: Ross Operating Valve Company, Troy, MI (US)

( * ) Notice: Subject to any disclaimer, the term of this patent is extended or adjusted under 35 U.S.C. 154(b) by 0 days.

(21) Appl. No.: 10/660,993

(22) Filed: Sep. 12, 2003

(51) Int. Cl.[7] ..... F15B 20/00
(52) U.S. Cl. ..... 137/14; 91/424; 137/596.16
(58) Field of Search ..... 91/424; 137/14, 137/596.16

(56) References Cited

U.S. PATENT DOCUMENTS 4,542,767 A 9/1985 Thornton et al.
5,796,571 A 8/1998 Wetzel et al.
5,912,795 A 6/1999 Wetzel et al.
5,927,324 A 7/1999 Russell et al.
6,478,049 B2 11/2002 Bento et al.

*Primary Examiner*—Gerald A. Michalsky
(74) *Attorney, Agent, or Firm*—Mark L. Mollon

(57) ABSTRACT

A double valve for controlling a machine tool has a memory such that when the valve is in its normal deactuated state and the inlet air supply is cycled (e.g., turned from on to off or from off to on), then the valve remains in the deactuated (i.e., ready to run) state. When the valve is in a faulted state (e.g., intermediate position) and the inlet air supply is cycled, then the valve remains in the faulted state. The memory is achieved by a balanced condition of the movable valve elements when in the normal deactuated position and an unbalanced or latched condition when in the intermediate or faulted position.

13 Claims, 6 Drawing Sheets

DYNAMICALLY-MONITORED DOUBLE VALVE WITH RETAINED MEMORY OF VALVE STATES

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to control valves, and, more specifically, to a double valve for controlling a single flow of pressurized fluid in response to simultaneous activation of a pair of control switches.

Machine tools of various types operate through a valving system, which interacts with a pneumatically-controlled clutch and/or brake assembly. For safety reasons, the control valves that are used to operate these machine tools require the operator to activate two separate control switches substantially simultaneously to ensure that an operator's hands are away from the moving components of the machine tool when an operating cycle is initiated. Typically, an electronic circuit responsive to the two control switches generates a pilot control signal applied to the pilot valves for switching the main fluid circuit of the valve to control delivery of compressed air (or other fluid) to the machine tool to perform its operating cycle.

Double valves operating in parallel in one valve body have been developed to ensure that a repeat or overrun of a machine tool operating cycle cannot be caused by malfunction of a single valve unit (e.g., a valve becoming stuck in an actuated position). Thus, if one valve unit fails to deactuate at the proper time, the double valve assumes a configuration that diverts the source of compressed air from the machine tool. A double valve is shown, for example, in commonly assigned U.S. Pat. No. 6,478,049 to Bento et al, which is incorporated herein by reference for all purposes.

In addition to providing protection against the repeat or overrun of the machine tool, it is desirable to monitor the double valve for a faulted valve unit and to prevent a new operating cycle of the machine tool from being initiated. Thus, prior art systems have caused the double valve to assume a lock-out configuration when a single valve unit is in a faulted condition so that the double valve cannot again be actuated until it has been intentionally reset to clear the faulted condition.

More specifically, a double valve assembly includes two electromagnetically-controlled pilot valves. Typically, the pilot valves are normally closed. The double valve assembly includes two movable valve units, each with a respective exhaust poppet between the outlet port and the exhaust port of the double valve and a respective inlet poppet between the outlet port and the inlet port of the double valve. When the pilot valves are normally closed, then the exhaust poppets are normally open and the inlet poppets are normally closed. Each of the pilot valves is moved to an actuated position in response to an electrical control signal from a respective operator-controlled switch, which typically causes the exhaust poppets to close and the inlet poppets to open. Any time that 1) a valve unit fails to deactuate properly, 2) a valve unit fails to actuate properly, or 3) the pilot valves are actuated or deactuated non-simultaneously, then at least one valve unit becomes locked in a faulted position where its exhaust poppet cannot be closed (thereby preventing the outlet from becoming pressurized).

During normal running conditions, the inlet to the double valve receives a continuous source of pressurized fluid. However, the source is periodically turned off (e.g., during maintenance or at the end of a work shift). When the pressurized fluid cycles off and on, pressures within different sections of the double valve acting upon various valve components decays and then rebuilds, thereby causing forces on the valve units not typically experienced during normal running conditions. In prior art double valves, the affect upon the movable valve units of cycling the pressure has typically been inconsistent and unpredictable. In many instances, a valve unit that was in a faulted state can end up being reset by the pressure cycling. This is undesirable because the failure of a valve that becomes faulted shortly before cycling the pressure might not be noticed before the pressure is turned off. If the faulted valve is reset by the pressure cycling, then the indication of a malfunction is lost and it may be possible for a valve that should be locked out to attempt to operate normally. On the other hand, it is also possible for a non-malfunctioning valve unit to inadvertently assume the faulted position when no fault has actually occurred, thereby requiring valves to be reset after cycling the pressure off and on which adds inefficiency in a manufacturing operation. Consequently, it would be desirable to provide a dynamic memory of the valve state during the cycling of inlet pressure so that each valve unit resumes the same state as it had when the pressure was removed.

SUMMARY OF THE INVENTION

The present invention provides a double valve with memory such that when the valve is in its normal deactuated state and the inlet air supply is cycled (e.g., turned from on to off or from off to on), then the valve remains in the deactuated (i.e., ready to run) state. When the valve is in a faulted state (e.g., intermediate position) and the inlet air supply is cycled, then the valve remains in the faulted state. The memory is achieved by a balanced condition of the movable valve elements when in the normal deactuated position and an unbalanced or latched condition when in the intermediate or faulted position.

In one aspect of the invention, a control valve system comprises a housing defining an inlet; an outlet and an exhaust, wherein the inlet is adapted to receive pressurized fluid. A first movable valve unit includes a first exhaust poppet and a first inlet poppet, wherein the first exhaust poppet is movable between an open position for coupling the outlet to the exhaust and a closed position for isolating the outlet from the exhaust, and wherein the first inlet poppet is movable between an open position for coupling the outlet to the inlet and a closed position for isolating the outlet from the inlet. The first movable valve unit is movable to an actuated position, a deactuated position, and an intermediate position, wherein the actuated position comprises the first inlet poppet being in its open position and the first exhaust poppet being in its closed position, wherein the deactuated position comprises the first inlet poppet being in its closed position and the first exhaust poppet being in its open position., and wherein the intermediate position comprises the first inlet poppet and the first exhaust poppet both being at least partially open.

A second movable valve unit includes a second exhaust poppet and a second inlet poppet, wherein the second exhaust poppet is movable between an open position for coupling the outlet to the exhaust and a closed position for isolating the outlet from the exhaust, and wherein the second inlet poppet is movable between an open position for coupling the outlet to the inlet and a closed position for isolating the outlet from the inlet. The second movable valve unit is movable to an actuated position, a deactuated position, and an intermediate position, wherein the actuated position comprises the second inlet poppet being in its open position and the second exhaust poppet being in its closed position, wherein the deactuated position comprises the second inlet poppet being in its closed position and the second exhaust poppet being in its open position, and wherein the intermediate position comprises the second inlet poppet and the second exhaust poppet both being at least partially open.

First and second crossover chambers communicate with the second and first inlet poppets, respectively. First and second flow restrictors couple the inlet to the first and second crossover chambers, respectively. First and second pilot valves are disposed at one end of the first and second movable valve units, respectively, for selectably urging the first and second movable valve units to the respective actuated positions.

When one of the first and second units is in the deactuated position and the pressurized fluid is removed from the inlet then substantially no net forces act on the one unit and it remains in the deactuated position. When the pressurized fluid is restored to the inlet then the one unit is urged into the deactuated position in response to pressure resulting from fluid flow into a corresponding crossover chamber via a respective flow restrictor.

BRIEF DESCRIPTION OF THE DRAWINGS

FIG. 6 is a state diagram showing the operation of a double valve according to the present invention when inlet pressure is cycled off and on.

DETAILED DESCRIPTION OF PREFERRED EMBODIMENTS

Figure 1:
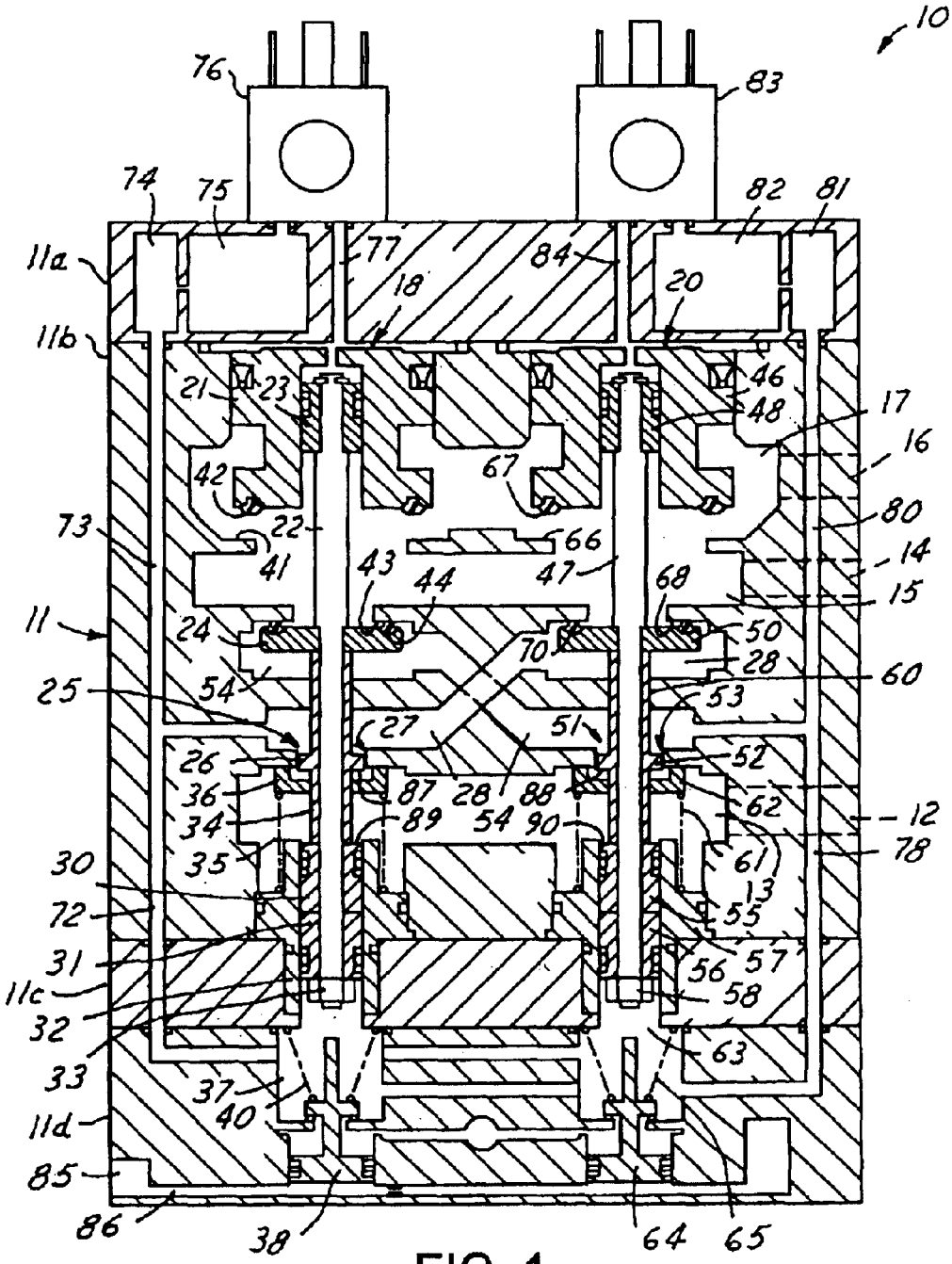
FIG. 1 is a cross-sectional view of a double valve according to a first embodiment of the present invention in its normal deactuated position.

Referring now to FIG. 1, a control valve system in the form of a double valve 10 includes a housing 11 having an inlet port 12 leading to an inlet chamber 13, an outlet port 14 leading to an outlet chamber 15, and an exhaust port 16 leading to an exhaust chamber 17. Housing 11 may include separate blocks 11*a*–11*d* which may be clamped or bolted together.

Chambers 13, 15, and 17 are joined by various passages to create elongated bores for receiving a first movable valve unit 18 and a second movable valve unit 20. First movable valve unit 18 includes an exhaust piston/piston/poppet 21 slidably received at one end of a stem 22 via a piston 23. First movable valve unit 18 also includes an inlet poppet 24 and a flow restrictor 25. A disk-shaped shoulder 26 extends from a spacer 34 that is fixed to stem 22. Shoulder 26 is slidably received in a passage 27 forming flow restrictor 25 so that pressurized fluid from inlet chamber 13 flows at a reduced rate into a first crossover chamber 28 when shoulder 26 is present in passage 27.

The lower end of stem 22 receives pistons 30 and 31 which are retained by a retainer nut 33 threaded to one end of stem 22. Pistons 30 and 31 are slidably received in a bushing 32 which is rigidly retained within housing 11.

A spring stop 36 is slidably received on spacer 34 and is urged in an upward direction by a return spring 35. Beneath movable valve unit 18, a return chamber 37 is formed which receives part of a reset piston 38 and a piston return spring 40.

First movable valve unit 18 is shown in FIG. 1 in its deactuated position wherein outlet port 14 is open to exhaust port 16 and closed to inlet port 12. Thus, exhaust piston/poppet 21 is in its upward, deactuated position wherein an exhaust seal 42 is spaced away from an exhaust seat 41. At the same time, an inlet seal 44 of inlet poppet 24 is disposed against an inlet seat 43.

Second movable valve unit 20 includes an exhaust piston/poppet 46 slidably received at one end of a stem 47 via a piston 48. Second movable valve unit 20 also includes an inlet poppet 50 and a flow restrictor 51. A disk-shaped shoulder 52 extends from a spacer 60 that is fixed to stem 47. Shoulder 52 is slidably received in a passage 53 forming flow restrictor 51 so that pressurized fluid from inlet chamber 13 flows at a reduced rate into a second crossover chamber 54 when shoulder 52 is present in passage 53.

The lower end of stem 47 receives pistons 55 and 56 which are retained by a retainer nut 58 threaded to one end of stem 47. Pistons 55 and 56 are slidably received in a bushing 57 which is rigidly retained within housing 11.

A spring stop 62 is slidably received on spacer 60 and is urged in an upward direction by a return spring 61. Beneath movable valve unit 20, a return chamber 63 is formed which receives part of a reset piston 64 and a piston return spring 65.

Second movable valve unit 20 is shown in FIG. 1 in its deactuated position wherein outlet port 14 is open to exhaust port 16 and closed to inlet port 12.

Thus, exhaust piston/poppet 46 is in its upward, deactuated position wherein an exhaust seal 67 is spaced away from an exhaust seat 66. At the same time, an inlet seal 70 of inlet poppet 50 is disposed against an inlet seat 68.

A fluid passage 72 provides fluid communication between first crossover chamber 28 and return chamber 63 of second movable valve unit 20. A fluid passage 73 provides fluid communication from first crossover chamber 28 to timing chambers 74 and 75 for providing pressurized fluid to an input of a first pilot valve 76. A passage 77 is coupled between the output of first pilot valve 76 and the upper surface of exhaust piston/poppet 21.

A fluid passage 78 provides fluid communication between second crossover chamber 54 and return chamber 37 of first movable valve unit 18. A fluid passage 80 provides fluid communication from second crossover chamber 54 to timing chambers 81 and 82 for providing pressurized fluid to an input of a second pilot valve 83. A passage 84 is coupled between the output of second pilot valve 83 and the upper surface of exhaust piston/poppet 46.

A reset port 85 communicates with a reset passage 86 for providing reset pressure to reset pistons 38 and 64 which extend upward to put first and second movable valve units 18 and 20 in their normal deactuated positions. When units 18 and 20 are in their deactuated positions and no pressure is being applied in any portions of the double valve, then valve units 18 and 20 are held in their upper, deactuated positions by friction (e.g., between pistons 30 and 31 and bushing 32). Preferably, the amount of friction provided is sufficient to maintain the movable valve units in their current positions against the force of gravity regardless of what orientation the valve body is placed.

When inlet pressure is first applied to inlet port 12, the movable valve units remain at their deactuated positions as follows. The pressure in inlet chamber 13 immediately reflects the increased pressure at inlet port 12. The surfaces of first movable valve unit 18 that are open to inlet chamber 13 include a first side 87 of shoulder 26 and an upper surface 89 of piston 30. These surfaces are provided with equal areas such that inlet pressure against the surfaces creates an upward force against surface 87 which is substantially exactly counterbalanced by a downward force against surface 89. Similarly, a surface 88 of shoulder 52 has an area substantially equal to a surface 90 of piston 55. Thus, a net force of substantially zero acts upon each of the movable valve units in response to the build up of pressure in inlet chamber 13.

Due to the imperfect seals of flow restrictors 25 and 51, pressure begins to build up in crossover chambers 28 and 54. As pressure builds up in the crossover chambers, the resulting pressure acts upon inlet poppets 24 and 50 to force them against their respective seats 43 and 68, respectively. The increasing pressure is also communicated to return chambers 37 and 63, which also creates an upward force to seat the inlet poppets. Pressure from the crossover chambers is also communicated to the timing chambers of pilot valves 76 and 83. After a short delay, pressure in the crossover chambers, return chambers, and timing chambers equalize with the pressure in inlet chamber 13.

Figure 2:
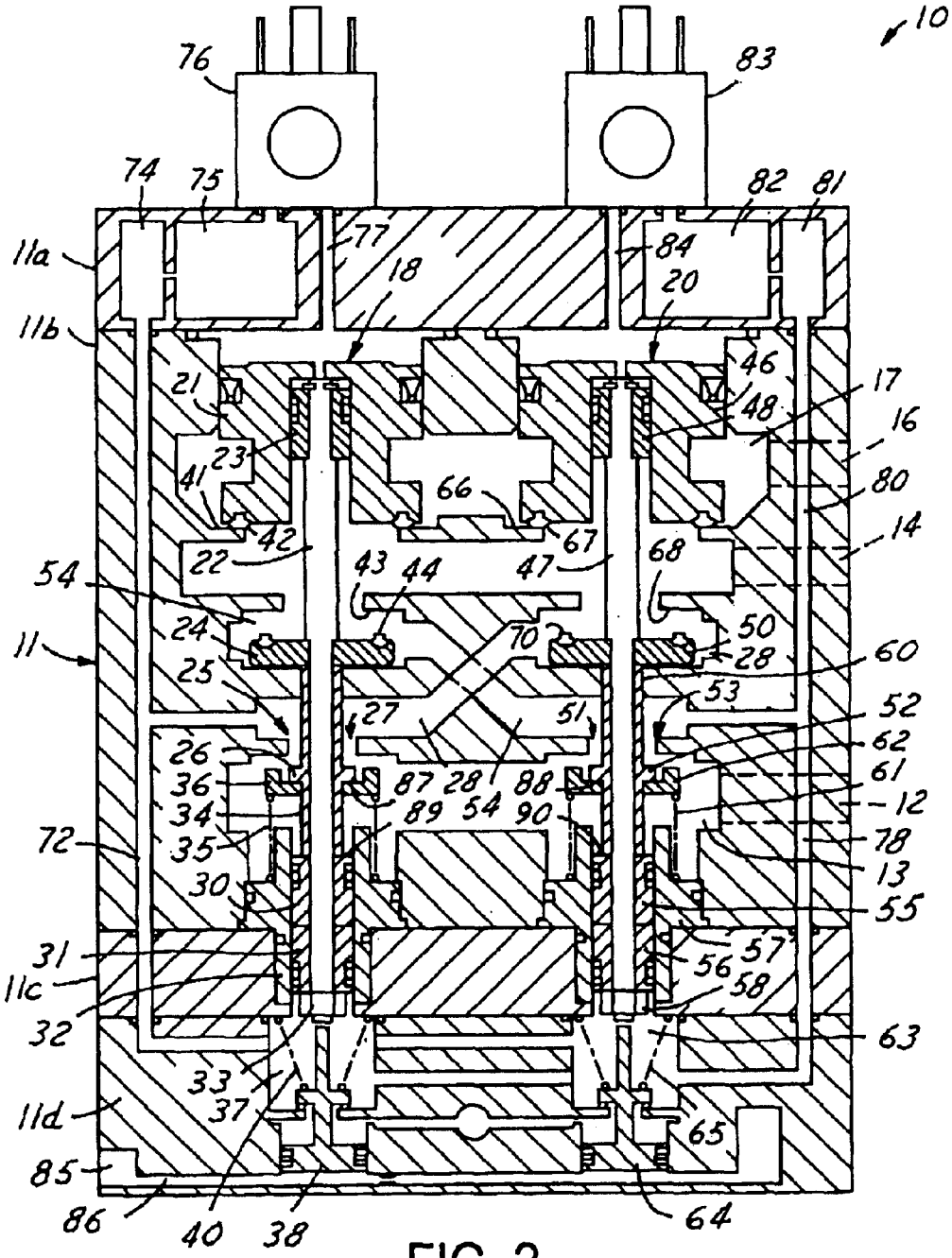
FIG. 2 is a cross-sectional view of double valve of FIG. 1 in its normal actuated position.

FIG. 2 shows double valve 10 in its normal actuated state. Since timing chambers 75 and 82 are fully pressurized when pilot valves 76 and 83 are turned on, the pressure applied from the pilot valves against exhaust piston/poppets 21 and 46 force them downward until exhaust seals 42 and 67 are seated on valve seats 41 and 66, respectively. Exhaust piston/poppets 21 and 46 force valve stems 22 and 47 downward, thereby unseating inlet poppets 24 and 50. Shoulders 26 and 52 of spacers 34 and 60, respectively, also move downward and displace spring stops 36 and 62 while also enlarging the opening at the flow restrictions to thereby increase the flow coefficient through the valve.

When the pilot valves are deactuated, pressurized fluid pressing against the top of exhaust piston/poppets 21 and 46 is exhausted through the pilot valves. Pressurized fluid in outlet chamber 15 and return chambers 37 and 63 apply an upward directed force against first and second movable valve units 18 and 20, which is opposed by only a smaller force acting against surfaces 89 and 90 in the inlet chamber 13. As a result, first and second movable valve units 18 and 20 move upward to their normal deactuated positions as shown in FIG. 1 to await the next actuation of pilot valves 76 and 83, while timing chambers 74, 75, 81, and 82 quickly become fully pressurized.

Figure 3:
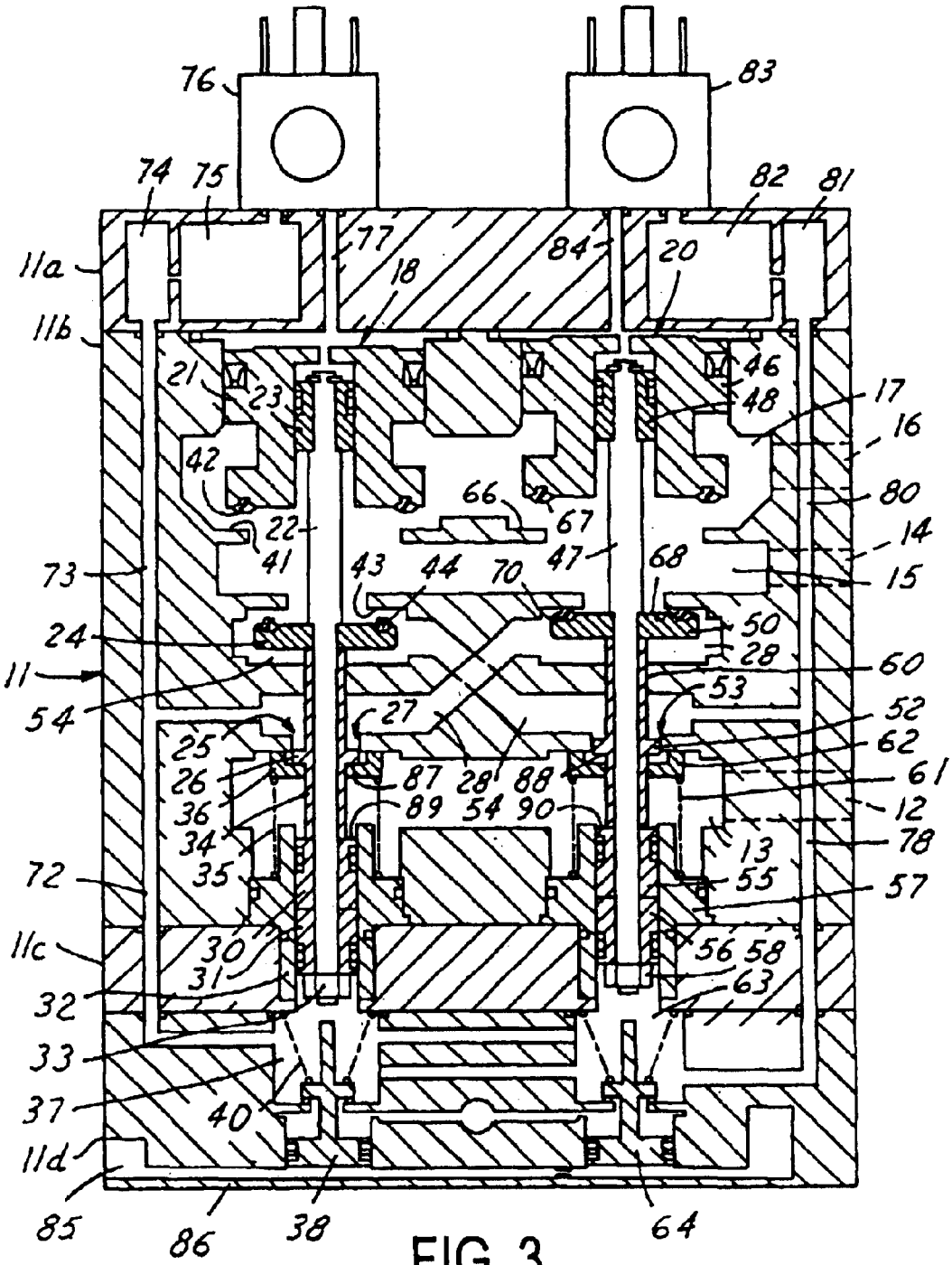
FIG. 3 is a cross-sectional view of double valve of FIG. 1 in a faulted state.
Figure 4:
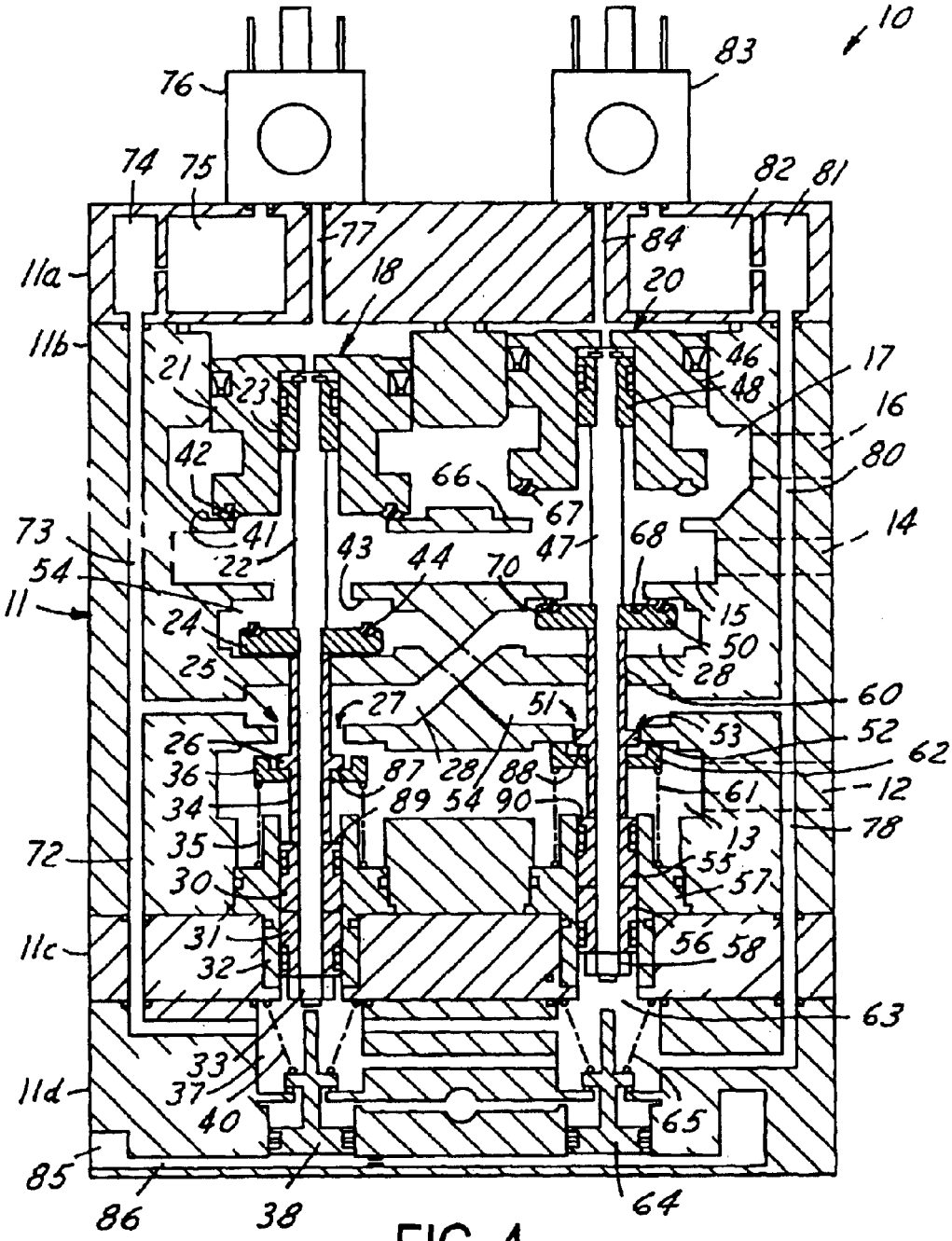
FIG. 4 is a cross-sectional view of double valve of FIG. 1 in a faulted state with the pilot valves turned on and attempting to actuate the double valve.

Operation of valve 10 after one movable valve unit has become faulted is shown in FIGS. 3 and 4. As shown in FIG. 3, the faulted state results when first movable valve unit 18 has failed to return to its deactuated position after turning off of pilot valve 76, for example. First movable valve unit 18 is shown at its intermediate position wherein both exhaust piston/poppet 21 and inlet poppet 24 are in an unseated condition. If movable valve unit 18 is in an actuated (i.e., fully downward) position when it first becomes faulted, return spring 35 will attempt to move first movable valve unit 18 to the intermediate position. Spring stop 36 prevents inlet poppet 24 from being moved to its closed position. With inlet poppet 24 open, second crossover chamber 54 is coupled to exhaust 16 via one or both of the exhaust valves. With second crossover chamber 54 exhausted, return chamber 37 is exhausted so that no return force can be generated on first movable valve unit 18. Timing chambers 81 and 82 are also exhausted so that double valve 10 is in a locked out condition wherein second movable valve unit 20 cannot be actuated by second pilot valve 83. Since inlet poppet 50 is closed, pressure builds in first crossover chamber 28 even though the other movable valve unit 18 is faulted. Crossover chamber 28 provides pressure to return chamber 63 and to timing chambers 74 and 75. Thus, when pilot valves 76 and 83 are actuated, faulted valve unit 18 receives full pressure at the top of exhaust piston/poppet 21 and can move into its fully actuated position. However, since exhaust piston/poppet 46 is open while inlet poppet is open, significant pressure cannot build in crossover chamber 54. Consequently, pilot valve 83 is not able to provide sufficient pressure to move second movable valve unit 20 from its deactuated position. Thus, double valve 10 remains in a locked out position at least until both movable valve units are reset by reset pistons 38 and 64.

In the event that inlet pressure is turned off while a movable valve unit is in its fully actuated position, then the valve unit is urged into the intermediate position by the corresponding return spring. The return spring cannot move the corresponding movable valve unit beyond the intermediate position due to the corresponding spring stop. The movable valve unit is prevented from moving all the way to its deactuated position by friction and/or gravity depending upon the orientation of the double valve. If inlet pressure is restored, pressure from the flow restrictor corresponding to the non-faulted movable valve unit is supplied into a crossover chamber which is open to exhaust through the faulted inlet poppet and at least the exhaust poppet of the non-faulted unit. Since full pressure builds up in the other crossover chamber (i.e., the crossover chamber fed by the flow restrictor of the faulted valve unit), a downward pressure against the flow restrictor from within the crossover chamber latches the faulted movable valve unit in the intermediate position against the return spring.

Figure 5:
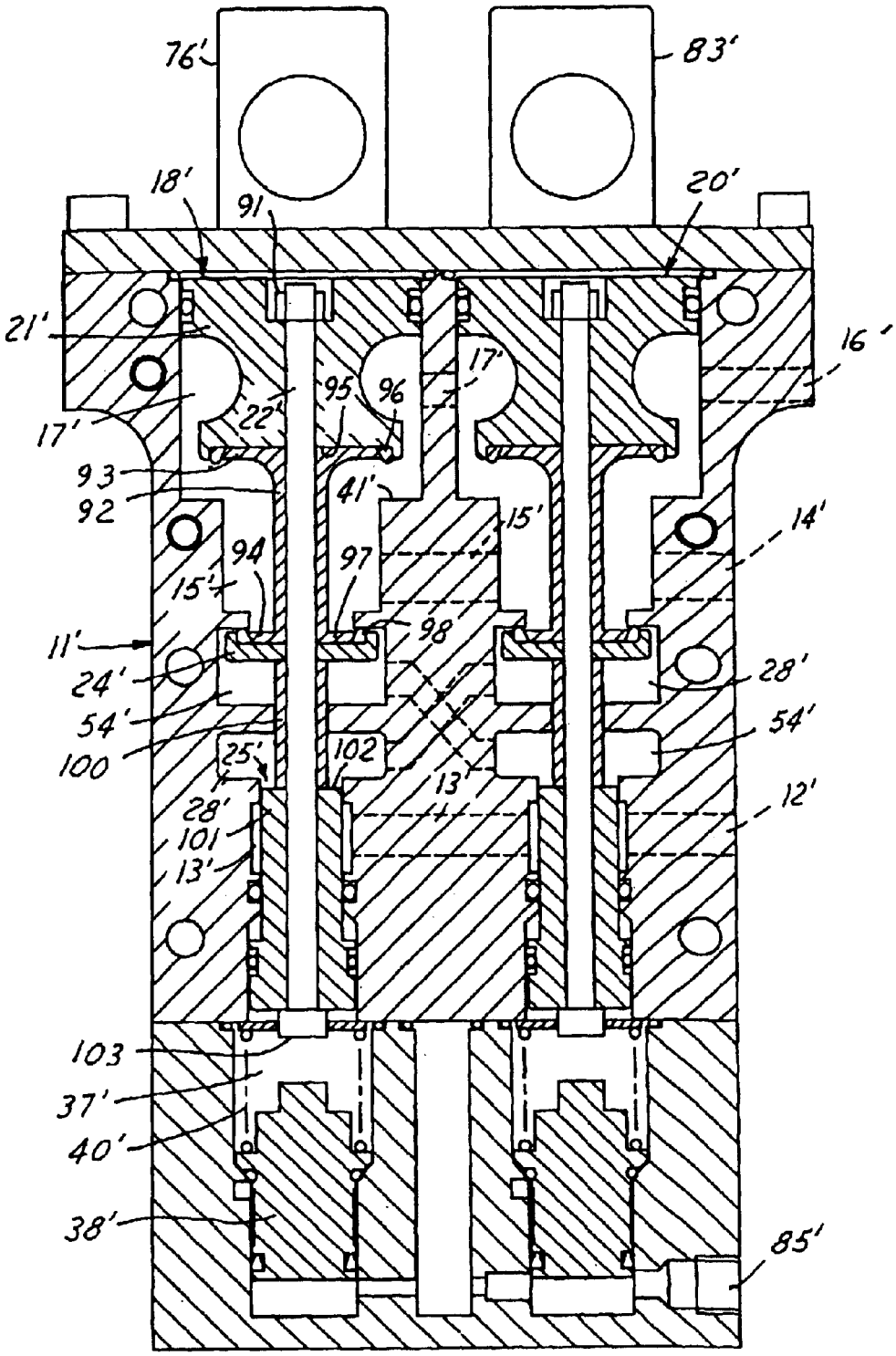
FIG. 5 is a cross-sectional view of double valve according to a second embodiment of the present invention in its normal deactuated position.

FIG. 5 shows an alternative embodiment of a double valve 10', which functions in essentially the same manner as the embodiment shown in FIGS. 1–4. Corresponding parts in FIG. 5 are designated using the same reference numbers with an added prime. Housing 11' includes a first movable valve unit 18' and a second movable valve unit 20'. Since the units are identical, only movable valve unit 18' will be described in detail.

A valve stem 22' has an exhaust piston/poppet 21' fixedly mounted at one end by a retaining nut 91. A spacer 92 has disc portions 93 and 94 at each axial end. Exhaust piston/poppet 21' includes a cavity 95, which is bowl shaped and receives disc portion 93 and an o-ring 96. O-ring 96 forms a face seal with exhaust seat 41' in the manner described in co-pending application Ser. No. 10/631,191, filed Jul. 31, 2003, incorporated herein by reference for all purposes. Likewise, inlet poppet 24' has a cavity 97 for receiving disc shaped portion 94 and an o-ring 98.

Also mounted to stem 22' are a spacer 100 and a piston 101. A boss 103 at the bottom end of stem 22' clamps the poppets, spacers, and piston in a fixed relationship on stern 22'. Piston 101 is shaped to provide a flow restrictor 25' between inlet chamber 13' and crossover chamber 28'. Piston 101 has a constant diameter throughout inlet chamber 13' so that it has no surfaces for exerting force in an axial direction on movable valve unit 18'. However, a top surface 102 is exposed to crossover chamber 28' for generating a downward latching force when in the faulted state as described earlier.

Figure 6:
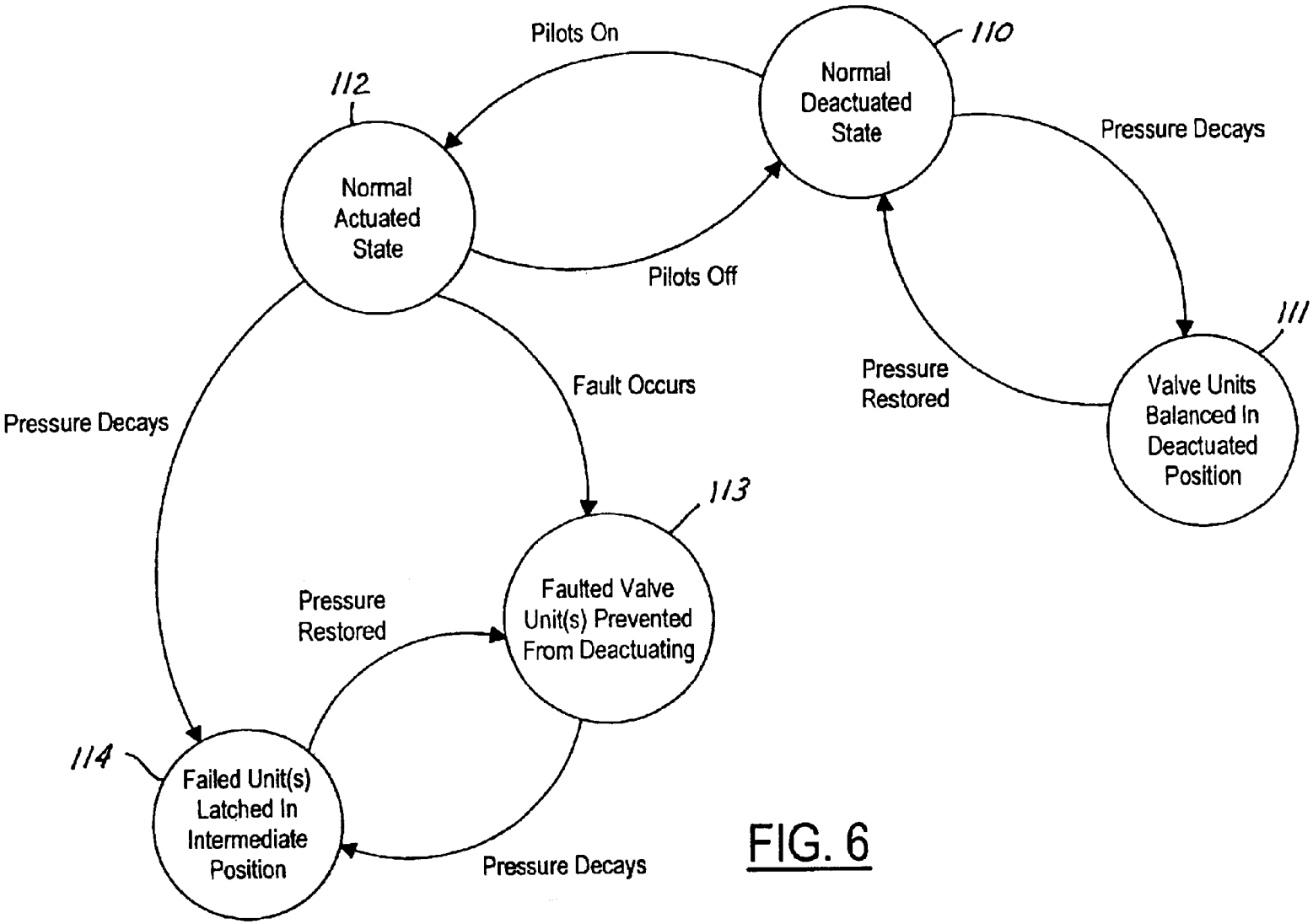

The transitions between operating states of the double valve of the present invention is shown in greater detail in FIG. 6. Beginning in a normal deactuated state 110 and if inlet pressure is cycled from on to off, then when the pressure decays a transition is made to a state 111 wherein the movable valve units are balanced in the deatuated position. Due to the balanced condition, the movable valve units are not moved regardless of any residual pressure in the inlet chamber. In other words, no net forces act on a valve unit and it remains in the deactuated position by virtue of friction between the valve units and the housing. When pressure is restored, the rising inlet pressure in the inlet chamber generates no net force against a valve unit. Fluid passes through the flow restrictors and builds pressure in the crossover chambers, resulting in a pressure that positively retains the valve units in the deactuated positions and a return is made to normal deactuated state 110.

From state 110, when both pilot valves are simultaneously actuated then a transition is made to normal actuated state 112. When the pilots are deactuated (e.g., be terminating the push button switch signals near the end of a machine operating cycle), then the valve units return to the deactuated position and the valve returns to normal deactuated state 110. If a fault occurs, however, a transition is made to faulted state 113 wherein the faulted valve units are prevented from deactuating.

If pressure at the inlet is removed, then a transition is made to state 114 wherein the faulted units are latched in the intermediate position by the action of the return spring and spring stops. When pressure is restored, the faulted valve unit is prevented from entering the deactuated position by returning to state 113.

If inlet pressure is cycled from on to off while in a normal actuated state 112, then as the pressure decays the valve units will both latch in the intermediate position and the valve will enter state 114. When pressure is restored, the valve continues to be locked out in a faulted condition in state 113 even though the valve was in a normal condition when pressure was turned off. Thus, the present invention has the additional advantage that if a machine tool is currently in an operating cycle when the inlet air supply is turned off, then the operating cycle of the machine tool does not resume when inlet air pressure is restored.

What is claimed is:

1. A control valve system comprising:

a housing defining an inlet, an outlet and an exhaust, said inlet being adapted to receive pressurized fluid;

a first movable valve unit including a first exhaust poppet and a first inlet poppet, wherein said first exhaust poppet is movable between an open position for coupling said outlet to said exhaust and a closed position for isolating said outlet from said exhaust, wherein said first inlet poppet is movable between an open position for coupling said outlet to said inlet and a closed position for isolating said outlet from said inlet, wherein said first movable valve unit is movable to an actuated position, a deactuated position, and an intermediate position, wherein said actuated position comprises said first inlet poppet being in its open position and said first exhaust poppet being in its closed position, wherein said deactuated position comprises said first inlet poppet being in its closed position and said first exhaust poppet being in its open position, and wherein said intermediate position comprises said first inlet poppet and said first exhaust poppet both being at least partially open;

a second movable valve unit including a second exhaust poppet and a second inlet poppet, wherein said second exhaust poppet is movable between an open position for coupling said outlet to said exhaust and a closed position for isolating said outlet from said exhaust, wherein said second inlet poppet is movable between an open position for coupling said outlet to said inlet and a closed position for isolating said outlet from said inlet, wherein said second movable valve unit is movable to an actuated position, a deactuated position, and an intermediate position, wherein said actuated position comprises said second inlet poppet being in its open position and said second exhaust poppet being in its closed position, wherein said deactuated position comprises said second inlet poppet being in its closed position and said second exhaust poppet being in its open position, and wherein said intermediate position comprises said second inlet poppet and said second exhaust poppet both being at least partially open;

first and second crossover chambers communicating with said second and first inlet poppets, respectively;

first and second flow restrictors coupling said inlet to said first and second crossover chambers, respectively; and first and second pilot valves disposed at one end of said first and second movable valve units, respectively, for selectably urging said first and second movable valve units to said respective actuated positions;

wherein when one of said first and second units is in said deactuated position and said pressurized fluid is removed from said inlet then substantially no net forces act on said one unit and it remains in said deactuated position, and when said pressurized fluid is restored to said inlet then said one unit is urged into said deactuated position in response to pressure resulting from fluid flow into a corresponding crossover chamber via a respective flow restrictor.

2. The control valve system of claim 1 wherein said first and second movable valve units are shaped such that said pressurized fluid in said inlet produces forces acting on said first and second valve units with substantially no components in an axial direction of said first and second movable valve units.

3. The control valve system of claim 2 wherein portions of said first and second valve units exposed to said pressurized fluid in said inlet are cylindrically shaped with a substantially constant diameter.

4. The control valve system of claim 2 wherein said first and second flow restrictors comprise first and second shoulders on said first and second movable valve units, respectively, each shoulder having a respective inlet side with a respective surface area exposed to said inlet, and wherein said first and second movable valve units include first and second piston surfaces opposing said first and second shoulders, respectively, and exposed to said inlet, said first and second piston surfaces providing respective surface areas equal to said surface areas of said inlet sides of said respective shoulders.

5. The control valve system of claim 1 wherein when one of said first and second units is in said actuated position or said intermediate position and said pressurized fluid is removed from said inlet then said one unit is prevented from moving into said deactuated position.

6. The control valve system of claim 1 wherein when one of said first and second units is in said actuated position or said intermediate position and said pressurized fluid is removed from said inlet then said one unit is prevented from moving into said deactuated position, and wherein when said pressurized fluid is restored to said inlet then said one unit is urged away from said deactuated position in response to pressure built up in a respective crossover chamber.

7. The control valve system of claim 6 wherein when said pressurized fluid is removed then said one unit is prevented from moving into said deactuated position at least partially by friction and at least partially by gravity.

8. The control valve system of claim 1 further comprising:

first and second return springs for urging said first and second movable valve units from said actuated position into said intermediate position.

9. The control valve system of claim 8 wherein when one of said first and second units is in said actuated position or said intermediate position and said pressurized fluid is removed from said inlet then said one unit is urged into said intermediate position by a respective return spring, and wherein when said pressurized fluid is restored to said inlet then said one unit is retained in said intermediate position against said respective return spring in response to pressure built up in a respective crossover chamber.

10. The control valve system of claim 1 further comprising:

first and second return chambers disposed at the other end of said first and second movable valve units, respectively, wherein said first and second return chambers are coupled to said second and first crossover chambers, respectively.

11. A method of providing memory of a normal valve state and a faulted valve state in a control valve system, wherein said control valve system includes a housing defining an inlet, an outlet and an exhaust, said inlet being adapted to receive pressurized fluid, wherein said control valve system includes a first movable valve unit including a first exhaust poppet and a first inlet poppet, wherein said first movable valve unit is movable to an actuated position, a deactuated position, and an intermediate position, wherein said control valve system includes a second movable valve unit including a second exhaust poppet and a second inlet poppet, wherein said second movable valve unit is movable to an actuated position, a deactuated position, and an intermediate position, wherein said control valve system includes first and second crossover chambers communicating with said second and first inlet poppets, respectively, wherein said control valve system includes first and second flow restrictors coupling said inlet to said first and second crossover chambers, respectively, wherein said control valve system includes first and second pilot valves disposed at one end of said first and second movable valve units, respectively, that are activated to selectably urge said first and second movable valve units to said respective actuated positions, wherein a normal valve state is comprised of a movable valve unit being in said deactuated position when a respective pilot valve is not activated, and wherein said faulted valve state is comprised of a movable valve unit being in said actuated position or said intermediate position when a respective pilot valve is not activated, said method comprising the steps of:

when a movable valve unit is in said normal valve state, then balancing said movable valve unit at said deactuated position when said inlet pressure is cycled off and on; and when a movable valve unit is in said faulted valve state, then latching said movable valve unit at said intermediate position when said inlet pressure is cycled off and on.

12. The method of claim 11 wherein said movable valve units are shaped such that pressurized fluid in said inlet generates substantially no net forces on said movable valve units in their axial direction.

13. The method of claim 11 wherein said latching step comprises building pressure in a respective crossover chamber of one movable valve unit in a faulted valve state, said respective crossover chamber being sealed by the other movable valve unit being in a normal valve state.

* * * * *